US007121883B1

(12) United States Patent
Petersen et al.

(10) Patent No.: US 7,121,883 B1
(45) Date of Patent: Oct. 17, 2006

(54) COAX CONNECTOR HAVING STEERING INSULATOR

(75) Inventors: Ebbe K. Petersen, Kalvehave (DK); Jens T. Johnsen, Frederiksberg (DK)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/145,764

(22) Filed: Jun. 6, 2005

(51) Int. Cl.
*H01R 9/05* (2006.01)

(52) U.S. Cl. ..... 439/582

(58) Field of Classification Search ..... 439/582, 439/583, 584, 578, 585
See application file for complete search history.

(56) References Cited

U.S. PATENT DOCUMENTS 4,165,911 A * 8/1979 Laudig ..... 439/314
5,154,636 A * 10/1992 Vaccaro et al. ..... 439/583
5,167,533 A * 12/1992 Rauwolf ..... 439/583
5,725,391 A * 3/1998 Masuda et al. ..... 439/582
5,785,554 A * 7/1998 Ohshiro ..... 439/584
6,126,482 A * 10/2000 Stabile ..... 439/582
6,609,931 B1 * 8/2003 Parrish et al. ..... 439/578
2003/0143892 A1 * 7/2003 Raypole et al. ..... 439/578
2004/0058582 A1 * 3/2004 Wendling et al. ..... 439/582

* cited by examiner

*Primary Examiner*—Tulsidas C. Patel
*Assistant Examiner*—Vladimir Imas
(74) *Attorney, Agent, or Firm*—Hiscock & Barclay, LLP

(57) ABSTRACT

The angled coaxial connector includes an insulator and inner conductor. The steering insulator serves to help guide, align, and locate an inner conductor in the bend of the angled connector. The steering insulator is adapted to receive and retain the inner conductor thereby framing and supporting the conductor. Furthermore, the inner conductor has an angled segment that is milled to have a width and a height, wherein the height of said angled segment is smaller than the width of the angled segment, more particularly, the width is substantially the same size as the diameter of the adjacent segments of the inner conductor. While the illustrated embodiment includes a substantially right angled connecter it is understood that the present invention is directed to connectors having either obtuse or acute angles as well.

2 Claims, 3 Drawing Sheets

COAX CONNECTOR HAVING STEERING INSULATOR

TECHNICAL FIELD

The present invention relates to a coaxial connector assembly, and in particular to an angled coaxial connector having an improved inner conductor and steering insulator.

BACKGROUND OF THE INVENTION

Angled coaxial cable connectors are typically used whenever a cable direction needs to be turned, for example in a 90° angle. These connectors prevent cable damage due to excessive bending, and serve to avoid obstacles that prohibit the connector to be directly connected to a device. Generally, angled cable connectors have a first end adapted to be attached to a device, such as a circuit board, and a second end that is spaced a distance from the circuit board that serves to mate to a coaxial cable. These connectors include an outer housing and a passage having a right angle bend and an inner conductor surrounded by an insulator. The inner conductor and insulator are fitted into the housing and are contained within an outer conductor sleeve.

An Insulator for use with inner conductors of angled connectors is described in U.S. Pat. No. 6,679,728 to Huang, et al. Huang, et al. disclosed a mini BNC connector, having a metal outer casing with two locating cylinders where each respective locating cylinder includes an insulator fitted within. A terminal is joined to this insulator and a respective conductor. The insulator also includes a through hole, and is joined to the respective conductor. The right angle inner conductor is created by attaching the terminal to the conductor. Because the terminal and the conductor are two separate portions, an additional step is required to affix the terminal to the conductor. The additional manufacturing step serves to increase the manufacturing expenses. This two pieced angled conductor may not be affixed properly, or may come apart in the field, thereby degrading signal quality.

U.S. Pat. No. 6,164,977 to Lester discloses a coaxial connector having a "board mount end" for mounting on a circuit board and a standoff. The connector includes a "mate end" insulator and a "mount end" insulator. The two separate insulators are installed in the two perpendicular ends. Because two separate insulators are used, additional time and steps are needed in production to assure proper installation. Also, the cost of two insulators adds to the manufacturing expenses.

What is needed is an insulator for use with the inner conductor of an angled coaxial connector that that is easily installed within the connector body and less expensive to manufacture.

An insulator for use with the inner conductor of an angled coaxial connector that serves to guide, align, and locate an inner connector in the bend of the coaxial connector would provide further utility.

SUMMARY OF THE INVENTION

The present invention provides an angled connector having an improved insulator for the inner conductor, wherein the insulator serves to guide, align, and locate the inner conductor in the bend of the angled connector. The insulator is adapted to receive the inner conductor, thereby framing and supporting the inner conductor within the angled connector. The insulator further serves to properly align the inner conductor so that it may receive the inner conductor of a connected coaxial cable. Additionally, the present invention provides an inner conductor having an angled segment and a substantially cylindrical segment, wherein the angled segment has a width that is substantially equal to the diameter of the substantially cylindrical segment.

A particular embodiment of the present invention provides an angled coaxial cable connector comprising an inner conductor having an angled segment and a substantially cylindrical segment, wherein the steering insulator configured to receive the angled segment of the inner conductor within the connector.

An additional embodiment of the present invention provides an angled coaxial cable connector having an inner conductor comprising an angled segment and a substantially cylindrical segment, wherein the steering insulator configured to receive the cylindrical segment of the inner conductor and to align the inner conductor within the connector.

BRIEF DESCRIPTION OF THE DRAWINGS

The foregoing summary, as well as the following detailed description of preferred embodiments of the present invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
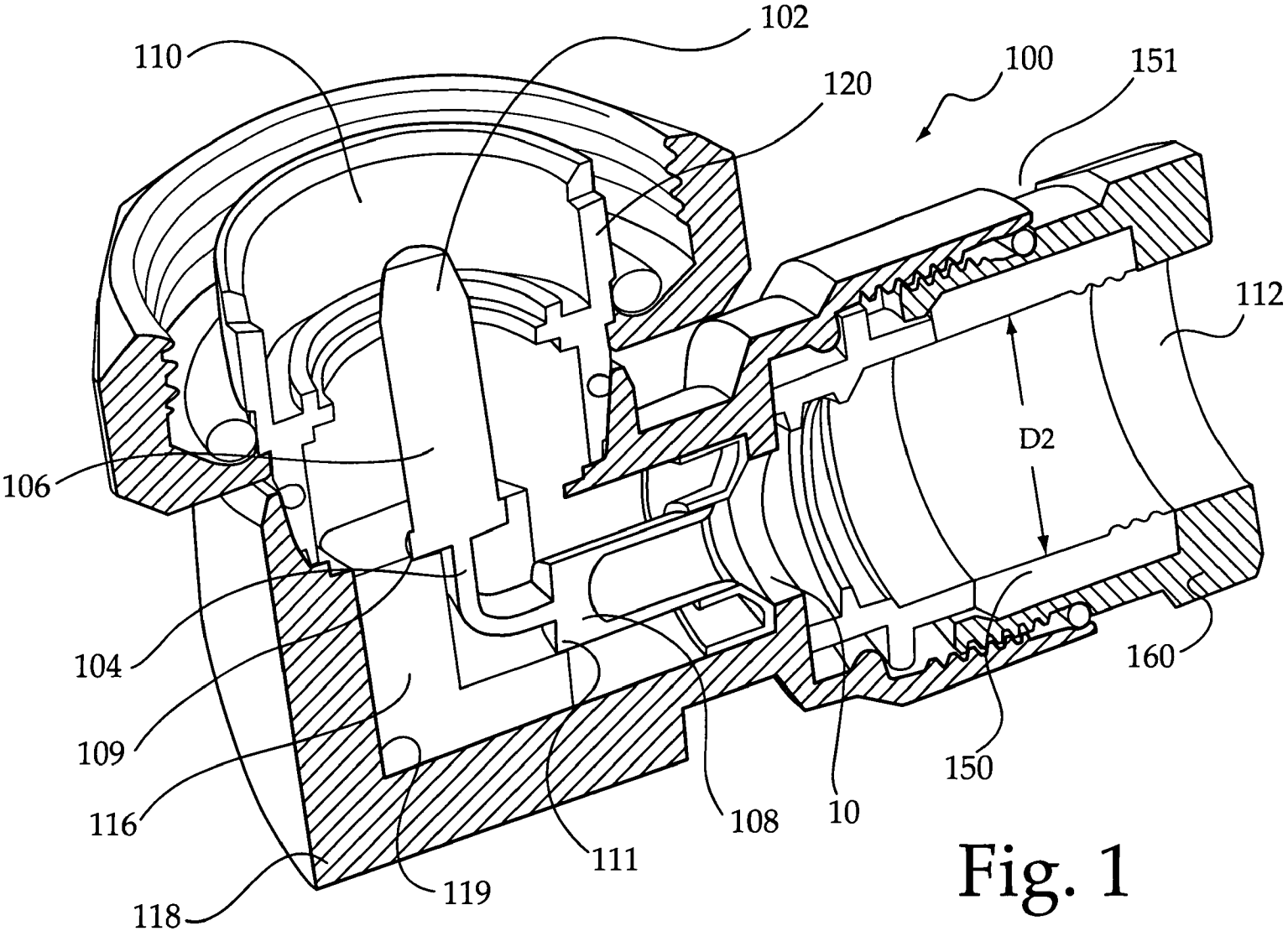
FIG. 1 is a cross sectional view of the angled coaxial connector of the present invention.

FIG. 1, shows a cross sectional view of the angled connector 100 of the present invention is shown. The improved angled coaxial connector includes an insulator and inner conductor. The steering insulator serves to help guide, align, and locate an inner conductor in the bend of the angled connector. The steering insulator is adapted to receive and retain the inner conductor thereby framing and supporting the conductor. The inner conductor has an angled segment that is milled to have a width and a height, wherein the height of said angled segment is smaller than the width of the angled segment, more particularly, the width is substantially the same size as the diameter of the adjacent segments of the inner conductor. The present invention is also directed to connectors having either obtuse or acute angles.

The angled connector assembly 100 includes a first end 110 adapted to be connected to an apparatus (not shown), such as a cable box or circuit board, and a second end 112 adapted to receive and retain a coaxial cable (not shown). As illustrated, the inner conductor 102 comprises an angled segment 104, between a first or pin segment 106 and a second or receptacle segment 108. It is understood that the inner conductor 102 of the present invention is comprised of a single unitary electrically conductive material. The steering insulator 116 is adapted to be seated within the connector housing 118, and serves to insulate the inner conductor 102. To better understand how the steering insulator 116 and the inner conductor 102 are seated within the connector housing 118, detailed description of the inner conductor 102 and the steering insulator 116 for use in the present invention are provided.

Figure 3:
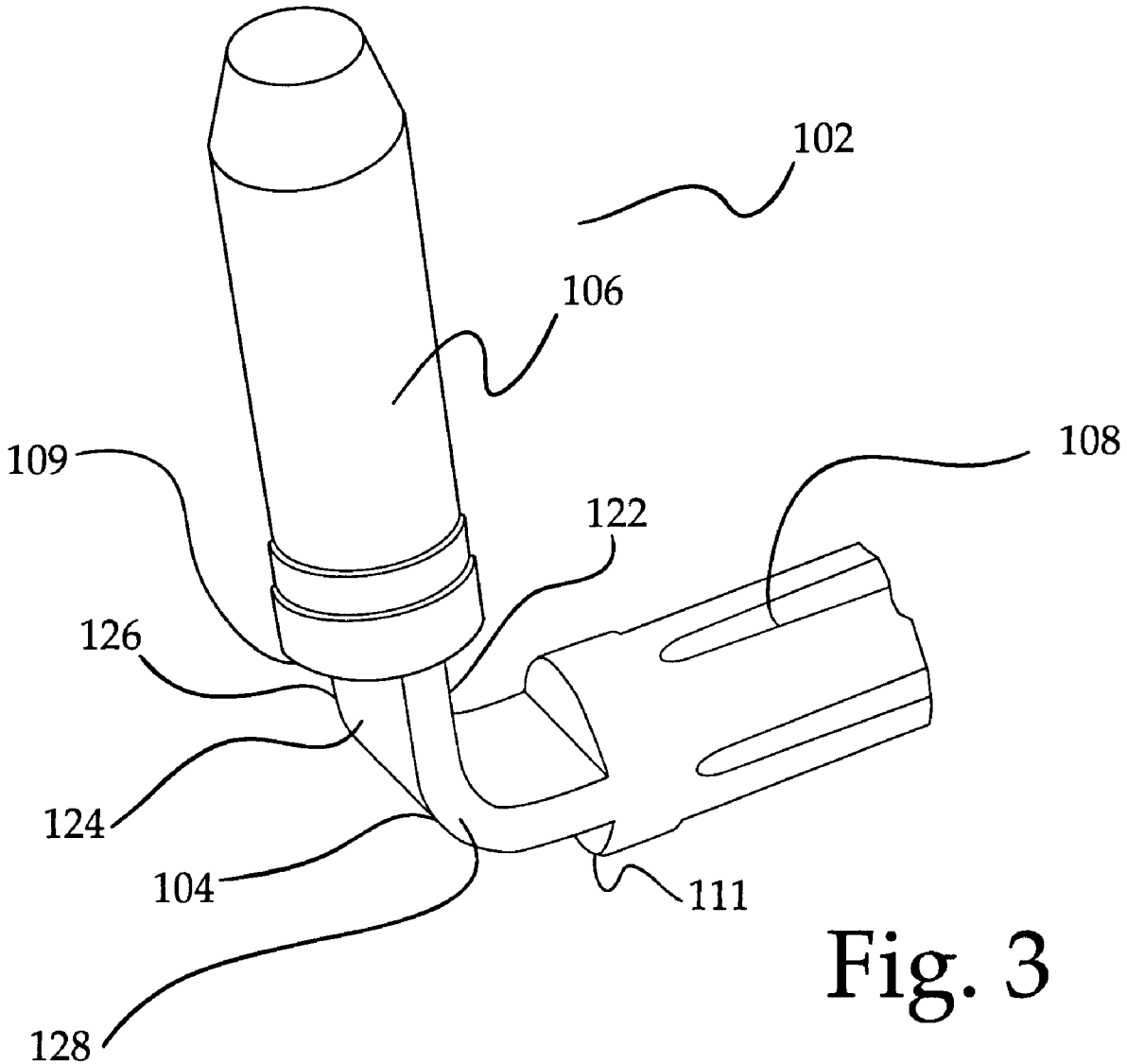
FIG. 3 is an elevated view of the conductor for use in the angled connector of the present invention.

FIG. 3 shows, an elevated view of the improved inner conductor 102 of the present invention is shown. The inner conductor 102 includes an angled segment 104, between a pin segment 106 and a receptacle segment 108. In the illustrated embodiment, the pin segment 106 includes a substantially cylindrical segment terminating at a frusto-conical end portion. The frusto-conical end portion adapted to easily fit within a receiving conductor member, such as an inner conductor contained within a receiving post. The opposing end of the inner conductor 102, the receptacle segment 108 includes a substantially cylindrical segment having a substantially cylindrical bore for receiving an inner conductor from an associated cable or connector. Additionally, in the illustrated embodiment, the receptacle segment includes a plurality of longitudinal bores throughout its axial length.

The pin segment 106 is adapted to be attached to a receptacle included within a device, such as a cable box or circuit board (not shown). In a particular embodiment of the present invention, the angled segment 104 of the inner conductor 102 is a substantially rectangular four sided segment, wherein two recessed sides 122 and 124 are substantially perpendicular to the remaining two sides 126 and 128. The sides 126 and 128 are immediately adjacent to the outer surface of the mating end 106 of the inner conductor 102. This configuration allows for the width of each the two recessed sides 122 and 124 to be substantially equal to the diameter of the pin segment 106 and the receptacle segment 108. Generally, to accommodate the angled segment, prior art inner conductors have a reduced diameter throughout. Because the width of the angled segment is substantially equal to the diameter of the adjacent segments, the novel configuration serves to provide a greater region thereby improving the dielectric properties of the center conductor and increasing the overall performance of the angled connector.

Figure 2:
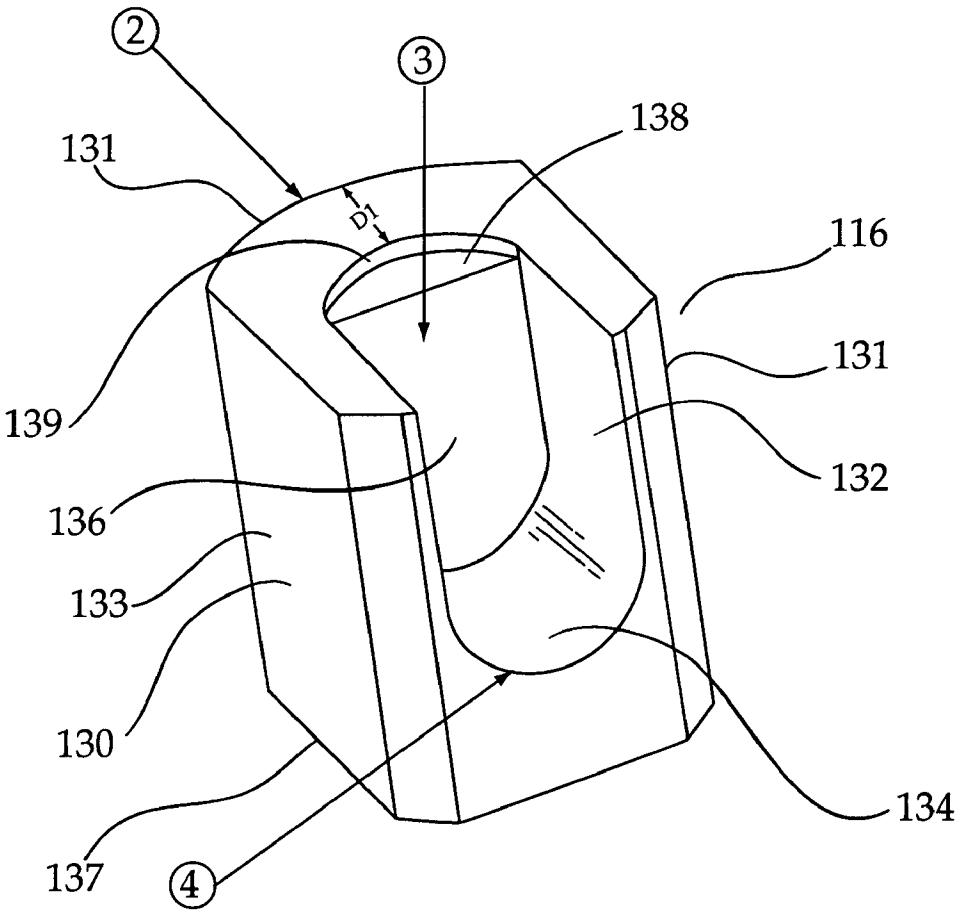
FIG. 2 is an elevated view of the steering insulator for use in the angled coaxial connector of the present invention.

Referring now to FIG. 2, an elevated view of the steering insulator 116 of a particular embodiment of the present invention is shown. The steering insulator 116 includes an outer region 130 that serves to communicate with the inner surface of the housing of the connector. The steering insulator 116 further includes an inner section 132, having a plurality of recesses or grooves adapted to receive and steer the inner conductor 102. In the illustrated embodiment, the pattern of recesses or grooves are configured to receive the features of the inner conductor 102 as shown in FIG. 2. More particularly, the features of the inner conductor 102 include, but are not limited to the pin segment 106 and the angled segment 104. FIG. 2 shows, the recess that includes a lower curved or cradle region 134, a substantially planer back wall 136, and an upper substantially flat recess 138 having a curved border 139. This configuration is designed to receive the inner conductor 102 as shown in FIG. 1 thereby allowing for precise positioning of the inner conductor.

Precise positioning of the inner conductor is accomplished by creating a steering insulator wherein the distance between the outer curved wall 131 and the upper substantially flat recess 138 having a curved border 139 is the appropriate distance D1 to accurately position the inner conductor 102 within the angled connector 100. The steering insulator 116 may be designed of plastic materials that serve to achieve the desired electrical performance including Teflon, Polycarbonate, Polypropylene, and Acetal.

FIG. 1 shows the connector assembly 100 of the present invention. In operation, the steering insulator 116 is positioned within the housing 118 wherein the outer surface 130 of the steering insulator 116 is in communication with the inner surface 119 of the housing 118. FIG. 2 illustrates that the outer surface 130 of the steering insulator 116 includes a curved surface 131 and a pair of substantially rectangular surfaces 133 and 135, as well as a lower surface 137. When positioned within the housing 118 of the angled connector 100, the walls of the outer surface 130 of the steering insulator 116 in abutting engagement with adjacent inner walls in the inner surface 119 of the housing 118. It should be noted that the curved channel or bore, forming the inner surface 119 of the housing 118 is less expensive to produce. The steering insulator 116 having a curved wall 131, such as that provided in the present invention, is adapted to fit within the less expensive bore, thereby adding an addition cost savings to the angled connector 100 of the present invention.

FIG. 1 shows the connector assembly 100 of the present invention. In operation, the steering insulator 116 is positioned within the housing 118 wherein the outer surface 130 of the steering insulator 116 is in communication with the inner surface 119 of the housing 118. FIG. 2 illustrates that the outer surface 130 of the steering insulator 116 includes a curved surface 131 and a pair of substantially rectangular surfaces 133 and 131, as well as a lower surface 137. When positioned within the housing 118 of the angled connector 100, the walls of the outer surface 130 of the steering insulator 116 in abutting engagement with adjacent inner walls in the inner surface 119 of the housing 118. It should be noted that the curved channel or bore, forming the inner surface 119 of the housing 118 is less expensive to produce. The steering insulator 116 having a curved wall 131, such as that provided in the present invention, is adapted to fit within the less expensive bore, thereby adding an addition cost savings to the angled connector 100 of the present invention.

Furthermore, a particular embodiment of the present invention includes a cable receptacle 151 having a gasket 150. The gasket 150 is situated within the inside of the back nut 160. In operation, when the gasket 150 is compressed in the axial direction, the internal diameter D2 is decreased. This decrease in diameter D2 securely connects the cable (not shown), to be attached to the connector 100 and the gasket 150. This feature also decreases the total amount of brass that is needed to produce the connector, thereby serving to reduce the cost associated with producing the connector. Because the gasket 150 is integrated with the back nut 160, the number of loose parts in the connector is minimized, thereby providing a simpler means for attaching a cable to a connector.

The embodiments illustrated do not limit the scope of the invention. Those skilled in the art will understand that various modifications of the specific embodiment are possible.

We claim:

1. An angled coaxial cable connector comprising:

an inner conductor comprising an angled segment and a substantially cylindrical segment;

a steering insulator configured to receive the angled segment of the inner conductor within the connector; and wherein the steering insulator further comprises a flat recess adapted to communicate with a planer portion of an angled segment of said inner conductor, and a curved recess adapted to communicate with two opposing sidewalls of an angled segment of said inner conductor.

2. An angled coaxial cable connector comprising:

an inner conductor comprising an angled segment and a substantially cylindrical segment;

a steering insulator configured to receive the cylindrical segment of the inner conductor and to align the inner conductor within the connector; and wherein the steering insulator further comprises a flat recess adapted to communicate with a planer portion of an angled segment of said inner conductor, and a curved recess adapted to communicate with two opposing sidewalls of an angled segment of said inner conductor.

* * * * *